US006655068B2

(12) United States Patent
Murello et al.

(10) Patent No.: US 6,655,068 B2
(45) Date of Patent: Dec. 2, 2003

(54) SHOULDER SUPPORT ELEMENT FOR A SMALL ARM

(75) Inventors: Johannes Murello, Deisslingen (DE); Wilhelm Fischbach, Deisslingen-Laufen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 09/911,006

(22) Filed: Jul. 23, 2001

(65) Prior Publication Data

US 2001/0052197 A1 Dec. 20, 2001

Related U.S. Application Data

(63) Continuation of application No. PCT/EP00/00601, filed on Jan. 26, 2000.

(30) Foreign Application Priority Data

Jan. 28, 1999 (DE) ..... 199 03 329

(51) Int. Cl.[7] ..... F41C 23/08; F41C 23/20
(52) U.S. Cl. ..... 42/74; 42/71.01
(58) Field of Search ..... 42/71.01, 72, 73, 42/74, 85

(56) References Cited

U.S. PATENT DOCUMENTS

| | | | | | |
|---|---|---|---|---|---|
| 1,088,362 | A | * | 2/1914 | Perkins | 42/73 |
| 1,266,024 | A | * | 5/1918 | Kennedy | 42/71.01 |
| 1,331,074 | A | * | 2/1920 | Marble | 42/71.01 |
| 1,795,840 | A | | 3/1931 | Crisler | |
| 2,350,484 | A | | 6/1944 | Williams | 42/85 |
| 2,763,951 | A | * | 9/1956 | Harvey | 42/71.01 |
| 3,208,180 | A | * | 9/1965 | Woodcock | 42/74 |
| 3,363,352 | A | * | 1/1968 | Pachmayr | 42/74 |
| 3,598,424 | A | | 8/1971 | Crouch et al. | 280/124 F |
| 3,604,138 | A | * | 9/1971 | Wilson | 42/74 |
| 3,625,539 | A | | 12/1971 | Crouch et al. | 280/112 R |
| 4,316,342 | A | | 2/1982 | Griggs | 42/74 |
| 4,601,123 | A | * | 7/1986 | Swearengen et al. | 42/70.01 |
| 4,663,876 | A | * | 5/1987 | Reaume | 42/71.01 |
| 4,713,905 | A | * | 12/1987 | Dupuy | 42/85 |
| 4,956,932 | A | * | 9/1990 | Cupp | 42/74 |
| 5,001,855 | A | * | 3/1991 | Griggs | 42/74 |
| 5,048,213 | A | | 9/1991 | Blenk | 42/71.01 |
| 5,068,991 | A | | 12/1991 | Reed | 42/71.01 |
| 5,235,765 | A | | 8/1993 | Chesnut | 42/74 |
| 5,329,718 | A | * | 7/1994 | Howard | 42/50 |
| 5,375,360 | A | * | 12/1994 | Vatterott | 42/74 |
| 5,471,776 | A | * | 12/1995 | Chesnut et al. | 42/74 |

(List continued on next page.)

FOREIGN PATENT DOCUMENTS

| | | |
|---|---|---|
| DE | 1942427 | 4/1970 |
| DE | 8913997 | 1/1990 |
| DE | 297 09 576 | 10/1997 |
| FR | 1092840 | 4/1955 |

OTHER PUBLICATIONS

*International Search Report* (and English–language translation) corresponding to International Patent Application Ser. No. PCT/EP00/00601, European Patent Office, dated May 6, 2000, 2 pages.

*International Preliminary Examination Report* (and English–language translation) corresponding to International Patent Application Ser. No. PCT/EP00/00601, International Bureau of WIPO, dated Jul. 31, 2001, 5 pages.

*Primary Examiner*—Charles T. Jordan
*Assistant Examiner*—Tara M Golba
(74) *Attorney, Agent, or Firm*—Grossman Flight, LLC

(57) ABSTRACT

A shoulder support element is disclosed for use in a firearm. The shoulder support element includes a shoulder support adapted to support the small arm in the firing position and a base plate removably mounted to the shoulder support such that impact forces applied to the base plate are distributed to the shoulder support.

17 Claims, 3 Drawing Sheets

U.S. PATENT DOCUMENTS 5,634,289 A * 6/1997 Wascher ..... 42/74
5,752,339 A * 5/1998 Bentley et al. ..... 42/74
5,979,098 A * 11/1999 Griggs ..... 42/73
6,012,246 A * 1/2000 Robinson et al. ..... 42/71.01
6,305,115 B1 * 10/2001 Cook ..... 42/74

* cited by examiner

SHOULDER SUPPORT ELEMENT FOR A SMALL ARM

RELATED APPLICATION

This patent arises from a continuation application which claims priority under 35 U.S.C. §120 from International Application No. PCT/EP00/00601, which was filed on Jan. 26, 2000.

FIELD OF THE INVENTION

The invention relates generally to firearms, and, more particularly, to a protective shoulder support element for a small arm having a shoulder support for supporting the small arm in the firing position.

BACKGROUND OF THE INVENTION

The position terms used in this patent, like "front", "back", "top", "bottom" or the like always assume a weapon in the normal firing position; (i.e., a weapon position in which the center axis of the barrel of the weapon runs generally horizontally and the direction of firing points "forward" away from the shooter).

For reasons of weight, weapon housings as well as the front and rear shaft have recently been manufactured from light plastic materials. This type of design (sometimes also thin-walled) of the housing and/or shaft can be readily deformed or even cracked, for example, when the weapon falls from some height, such as from the loading surface of a truck onto the ground and strikes the rear shaft. To remedy this problem, it is known to mount on the rear end of the weapon housing (in weapons in the bullpup design) or on the rear face of the rear shaft (in ordinary weapons) a so-called base or shoulder plate. In these approaches, the back side of the weapon housing or the rear shaft, which represents one of the main stress zones, is covered to the rear by the base plate. The base plate is then supposed to take up all undesired loads acting on the weapon from the rear, especially transverse loads. Ordinarily the base plate is mounted on the weapon housing from the rear (in weapons in the bullpup design) or on the rear shaft (in ordinary weapons) by several screws running in the longitudinal direction of the weapon.

This protective measure, however, has not always proven sufficient. During severe stress (for example, upon falling from great height), the force transfer over the few screw connections of the base plate leads to damage to the weapon housing or rear shaft. There is also the hazard that the screw connections will be torn out from their mount in the base plate during transverse loading.

A recoil-damping shoulder support element for a weapon is known from U.S. Pat. No. 4,316,342. The base plate of this shoulder support element is connected to the shoulder support via a tongue-in-groove connection formed between the base plate and a shoulder support. This solution is primarily conceived for automatic weapons with rapid firing, in which the recoil is so strong that suitable use of the weapon is no longer possible. For this purpose, the shoulder support element is divided into two parts, namely, (a) a first section which is rigidly connected to the rear end of the small arm, and (b) a second section that is moveable relative to the first section along the shoulder support height. The second section is guided, for example, on a rail and held in a rest position via a retaining spring and optionally guided back after deflection by a recoil.

Shoulder support elements of the type just mentioned with a one-part base plate are known, for example, from DE-GM 1,942,427, U.S. Pat. No. 5,235,765 and FR-PS 1,092,840.

SUMMARY OF THE INVENTION

In accordance with an aspect of the invention, a shoulder support element is provided for use in a firearm. The shoulder support element includes a shoulder support adapted to support the small arm in the firing position and a base plate removably mounted to the shoulder support such that impact forces applied to the base plate are distributed to the shoulder support.

BRIEF DESCRIPTION OF THE DRAWINGS

Identical reference numbers refer to the same elements throughout the figures.

DESCRIPTION OF THE PREFERRED EMBODIMENTS

Figure 1:
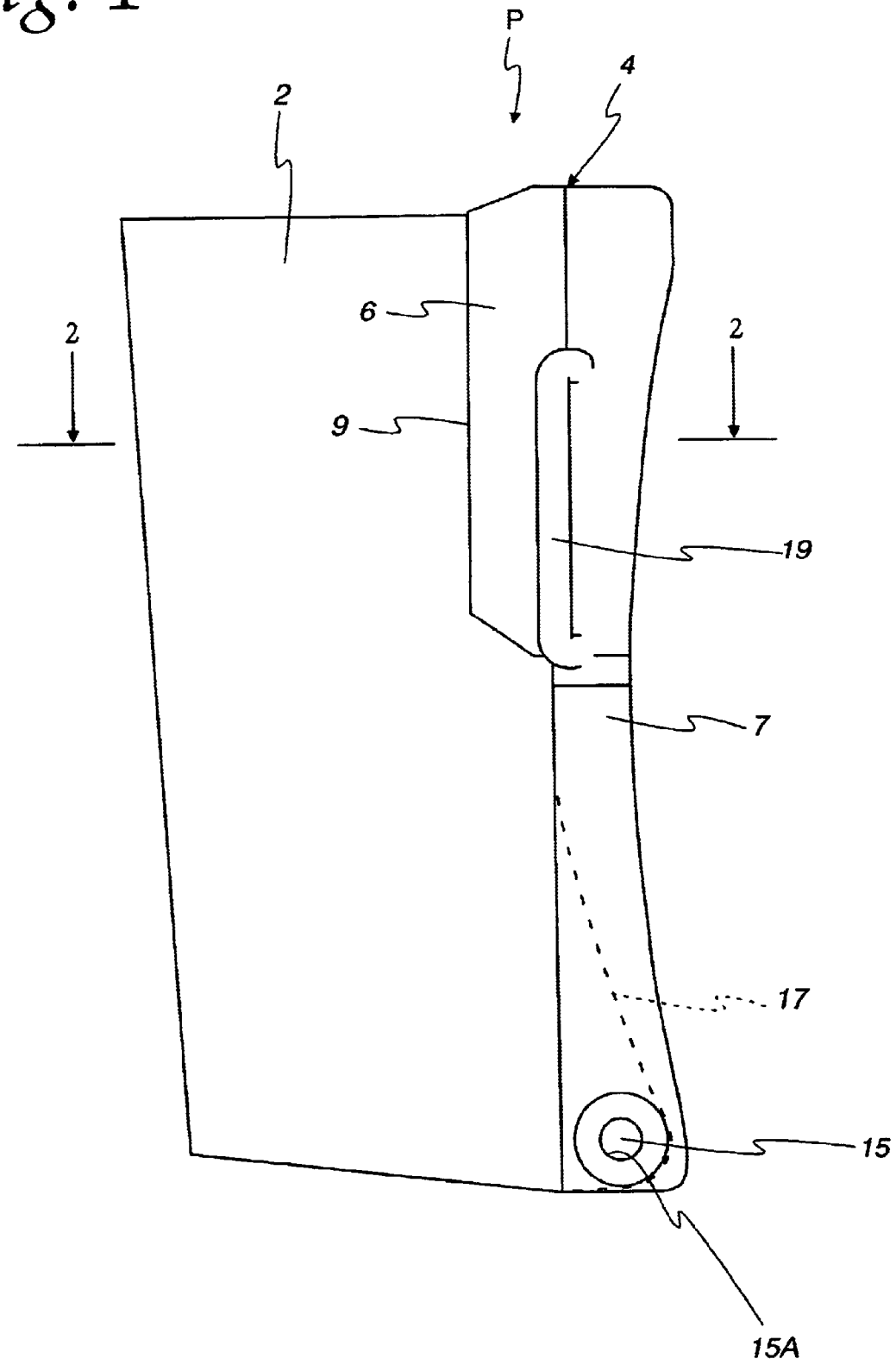
FIG. 1 is a side view of a shoulder support element constructed in accordance with the teachings of the instant invention.
Figure 2:
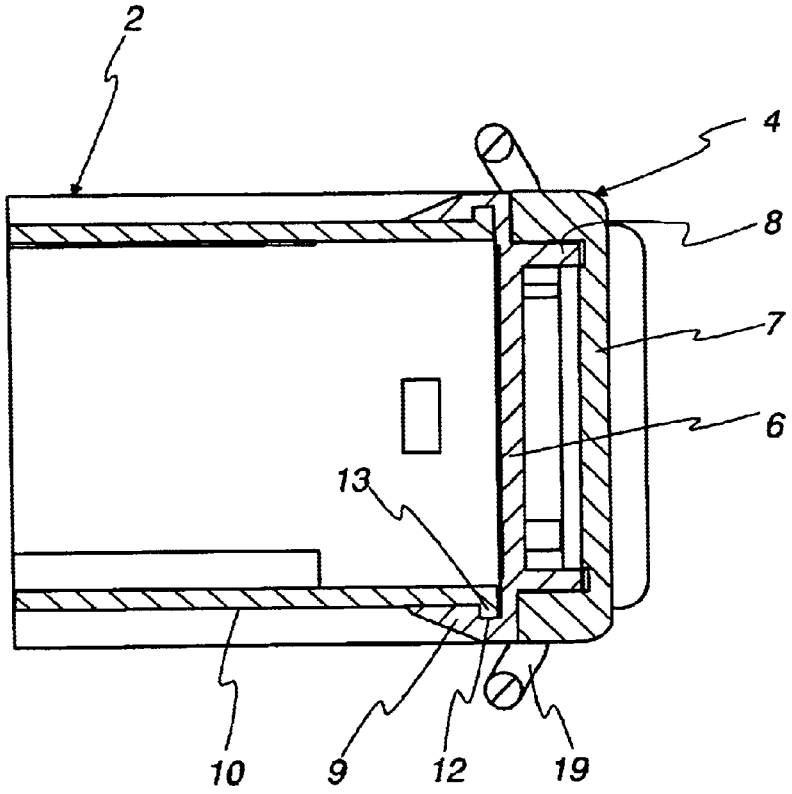
FIG. 2 is a sectional view taken along line II—II of FIG. 1.

FIGS. 1 and 2 show the rear end of a shoulder support element constructed in accordance with the teachings of the invention. The depicted shoulder support element belongs to a semiautomatic rifle of the so-called bullpup design. In this design, the fixed or collapsible rear shaft which is commonly located in conventional weapons behind the rear end of the weapon housing is absent so that the shoulder support element itself is the rearmost section of the weapon housing. Although the shoulder support element will be explained in this context, persons of ordinary skill in the art will appreciate that it is suitable for any small arm type, (e.g., semiautomatic rifles, rapid fire weapons, submachine guns, machine guns, ordinary hunting weapons and rifles, and even firing shafts for pistols).

A section of a shoulder support 2 is depicted in FIGS. 1 and 2, which, as stated, is part of a box-like weapon housing that is open to the rear. A base or shoulder plate 4 is mounted on the rear end of the shoulder support 2. The shoulder support 2 is substantially hollow and, for reasons of weight savings, is made from a thin-walled light plastic. The main functions of the base plate 4 are: (1) protection of the shoulder support 2 from damage when the weapon is placed on the ground or when the weapon falls from a height onto the ground, and (2) as a stop for the recoil spring 55 and the recoiling bolt assembly (not shown). In addition, the back side of the base plate 4 includes a concave rounding so that the shoulder support 2 lies comfortably and securely on the shoulder of the shooter in the firing position of the weapon.

In the present practical example, the base plate 4 is assembled from two parts: a closure piece 6 and a covering cap 7. As shown in FIG. 1, the closure piece 6 extends over only about half of the shoulder support 2. As shown in FIG. 2, the closure piece 6 has two reinforcement ribs 8 on its rear free side that run over its entire height across the longitudinal direction of the weapon. These ribs 8 protrude above the rear end of the shoulder support 2 and ensure effective stiffening of the closure piece 6. They also serve as fastening surfaces for the covering cap 7.

In addition, the closure piece 6 has a front fastening section 9, which lies outside of the shoulder support wall 10 (see FIG. 2) and runs along the upper peripheral half of the shoulder support 2 as shown in FIG. 1. A groove 12 is located inside of the fastening section 9, facing the shoulder support wall 10. The groove 12 runs across the longitudinal direction of the weapon and is formed substantially all the way around the weapon. A retaining connector/tongue 13 of complementary design and located on the rear edge of the shoulder support wall 10 engages in this groove 12. The retaining connector/tongue 13, like the groove 12, also runs across the longitudinal direction of the weapon and is directed outward. Preferably, the retaining connector 13 is formed only on the edge region of the shoulder support wall 10 which region is covered by the fastening section 9 on the closure piece 6 (i.e., it is formed only on about the upper peripheral half of the shoulder support wall 10). The retaining connector 13, however, can alternatively be located fully peripherally on the rear edge of the shoulder support 2.

As shown in FIG. 1, the covering cap 7 extends over the entire height of the shoulder support 2. As shown in FIG. 2, the upper half of the cap 7 is located on the closure piece 6 so that the covering cap 7 encloses the two ribs 8 of the rear retaining section of the closure piece 6 and so that the cap 7 is substantially flush with the outer edge of the fastening section 9. The covering cap 7 is made from a foamed plastic or elastomer. The closure piece 6 can also be made of plastic (preferably fiber-reinforced plastic), or metal. The covering cap 7 is welded or glued unreleasably at the two retaining sections 8 to closure piece 6 to form one piece. However, they can also be cast with each other or be formed one onto the other.

Figure 3:
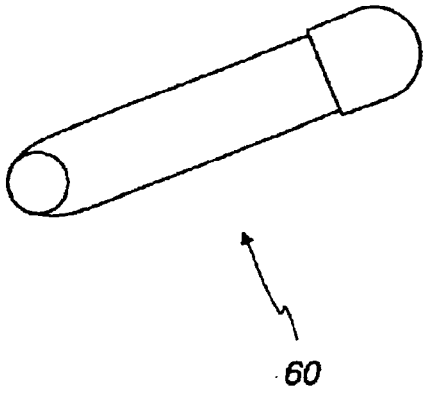
FIG. 3 is an illustration of an example safety pin.

The base plate 4 (which is assembled from the closure piece 6 and the covering cap 7) is pushed onto the shoulder support 2 during assembly from the side or from the top in the direction of the arrow P in FIG. 1 along the rail-like tongue-in-groove connection formed by groove 12 and retaining connector 13 to the stop of the fastening section 9. To secure and lock the pushed-on base plate 4, a hole 15 is provided in the lower end region of the covering cap 7. A safety pin 60 (see FIG. 3) can be pushed through this hole 15.

The shoulder support 2 is also formed with the end profile depicted with the dashed line in FIG. 1 such that the support 2 protrudes with a tab-like protrusion 17 into the interior of the covering cap 7 above the positioning hole 15. The shoulder support wall 10 also has a hole 15A that coincides with the hole 15 in the covering cap 7 at least on the front side so that the safety pin 60 can be pushed through. As an alternative, securing can also occur via a snap hook 50 on the covering cap 7.

In this type of connection between the base plate 4 and the shoulder support 2, impact and transverse forces occurring during any fall of the weapon are taken up over the entire length of the tongue-in-groove connection and correspondingly distributed to the shoulder support 2. The potential for destruction in free fall is therefore significantly reduced. A sling swivel 19 is attached to the front side and preferably also the back side of the covering cap 7 of the base plate 4. Loads introduced to the sling swivel 19 are thus advantageously taken up by the base plate 4 and are introduced uniformly into the shoulder support 2 along the tongue-in-groove fastening of the base plate 4 to the shoulder support 2. The covering cap 7 or the entire base plate 4 can also be elastically deformable to a limited extent for this purpose.

From the foregoing, persons of ordinary skill in the art will appreciate that the disclosed shoulder support element for a small arm better withstands exposure to force, especially transverse and/or longitudinal loads than prior art devices.

The disclosed shoulder support element is particularly adapted for use in a small arm such as a semiautomatic rifle or submachine gun. It includes a shoulder support 2 for supporting the small arm in the firing position and a base plate 4, which is arranged on the rear end of the shoulder support 2 for its protection. The base plate 4 is connected to the shoulder support 2 via a groove and tongue connection formed between the base plate 4 and the shoulder support 2. The base plate 4 is constructed from: (1) at least one closure piece 6 which overlies at least one section of the shoulder support 2 and has a fastening section that forms a tongue-in-groove connection with the shoulder support wall 10; and (2) at least one covering cap 7, which is mounted on the closure piece 6. The closure piece 6 is preferably made from metal or reinforced plastic. The covering cap 7 is preferably made from a comparatively softer material than the closure piece 6.

In this manner, the base plate 4 is simply designed and therefore cost-effective, but at the same time forms a particularly damage resistant protection of the shoulder support 2. Any bending and transverse forces that act on the base plate 4 (for example, in the event of a fall), are introduced "gently" into the shoulder support 2 over the entire length of the tongue-in-groove connection. In a thin-walled weapon design in particular, this leads to a significantly reduced likelihood of damage to the support 2 when the weapon falls on the ground. At the same time, the tongue-in-groove connection (which is provided for gentle force introduction from the base plate) stiffens the rear face of the shoulder support 2 and additionally forms a rail-like guide via which the base plate 4 can be pushed conveniently onto the shoulder support 2 and removed again, as explained further below.

In the normal case, critical loads are not reached with the base plate 4 described herein when transverse forces are introduced to the shoulder support 2. However, should damage to the base plate 4 occur during above-average loading, only the base plate 4 must be replaced, but not the shoulder support 2 itself (e.g., not the entire weapon housing in a weapon in the so-called bullpup design).

As a precaution, it is pointed out that the terms "shoulder support element" or "shoulder support" employed in this patent do not refer narrowly to the rear shaft of a weapon in the conventional design, but refer in general to that section of a small arm that is supported on the shoulder of the shooter in the normal firing position. For example, in the case of a weapon in the bullpup design, "shoulder support" refers to the rearmost section of the weapon housing, and in the case of a weapon in a conventional design, "shoulder support" refers to the rear shaft.

The tongue-in-groove connection between the shoulder support 2 and the base plate 4 can extend across the longitudinal direction of the weapon over the entire periphery of the shoulder support 2. However, the tongue-in-groove connection preferably runs only over sections on the front and/or back side of the shoulder support 2. With particular preference, the tongue-in-groove connection extends across the longitudinal direction of the weapon roughly along the upper peripheral half of the shoulder support 2. In the last-named approach, the base plate 4 can be conveniently pushed onto the shoulder support from the side or from the top of the small arm. Moreover, the upper section of the base plate 4 so fastened offers a stable support surface, for example, for the recoil spring 55 of the bolt assembly (not shown) in weapon types in the bullpup design in which the back side of the weapon housing is open and the recoil spring 55 is supported rearward on the base plate 4. In this case, the tongue-in-groove connection of the weapon housing and base plate 4 also permits gentle force introduction during the closure process when the bolt assembly encounters the base plate.

To implement the tongue-in-groove connection, one or more complementary tongues 13 and grooves 12 are formed on the shoulder support 2 and base plate 4. The engagement of these tongues 13 and grooves 12 enable the base plate to be mounted on the shoulder support 2 in force-transferring fashion. The connectors/tongues 13 are preferably configured as strips on the shoulder support 2 and the grooves 12 are preferably configured on the base plate 4. With particular preference, the base plate 4 has a fastening section that lies against the outside of the shoulder support wall 10. This section includes a groove 12 directed toward the shoulder support wall 10 in which a complementary retaining connector 13 in the rear edge of the shoulder support wall 10 engages. As an alternative, a mirror-image arrangement of the groove and tongue is also conceivable, namely a groove running on the rear edge of the shoulder support wall 10 and a protruding retaining connector/tongue on the fastening section of the base plate 4. As an additional alternative, the fastening section of the base plate 4 can also lie against the inside of the shoulder support wall 10 with corresponding design of the tongue-in-groove fastening, which corresponds to the two alternatives just mentioned. In any of the different configuration possibilities, the interfering forces are preferably transferred along the entire length of the flange of the tongue-in-groove connection. The connectors 13 and grooves 12 transfer bending and transverse forces impinging laterally on the base plate 4 to the shoulder support 2 via the tongue-in-groove connection. The connectors 13 also reinforce the rear end of the weapon significantly. This tongue-in-groove connection also permits problem-free and convenient replacement of the base plate 4 by simple shifting of the base plate 4.

The illustrated base plate 4 is assembled from several parts that are produced from different materials (for example, metal and plastic or different plastic materials), and joined together in one piece. The parts are preferably glued, cast, foamed or welded together. As an alternative, the parts of the base plate 4 can also be releasably locked to each other, for example, by means of an additional closure element, as described above in conjunction with locking of the groove-tongue connection 12, 13.

The closure piece 6 of the base plate 4 is preferably produced from sheet-metal or fiber-reinforced plastic. The covering cap 7 is preferably produced from tough or impact-resistant plastic. Depending on the requirements, this design variant permits a deliberate selection of materials as the base plate 4 components. The closure piece 6, which carries the connection between the base plate 4 and the shoulder support 2 and, as mentioned, may also serve as a support for the recoil spring 55 in certain types of weapons, is accordingly made from a hard and distortion-proof material. On the other hand, the covering cap 7 of the shoulder support 2, on which the weapon lies in the firing position, is made from a comparatively softer but preferably tough and impact-resistant plastic, foamed plastic or elastomer. The covering cap 7 is preferably also made from an elastic (for example, foamed plastic or elastomer) so that it can also exert a recoil-damping effect. Reinforcement ribs 8 are additionally provided, preferably on the free end of the closure piece 6 of the base plate 4, which stiffen the structure of the closure piece 6, and, at the same time, serve as fastening sites for the covering cap 7, which is welded, glued to it or can be foamed onto it.

After mounting of the base plate 4 on the shoulder support 2 of the small arm, the base plate 4 can be connected unreleasably (for example, by gluing) to the shoulder support 2. However, a safety closure for releasable locking of the tongue-in-groove connection is preferably provided on the base plate 4. With particular preference, the base plate 4 has a through hole 15 for this purpose, which in the mounted state coincides with a corresponding hole 15A in an end section of the shoulder support 2 that extends into the base plate 4 and is provided to accommodate a safety pin 60. As an alternative, the base plate 4 may be designed so that it extends into the shoulder support 2 with one or more fastening sections, in which a through-hole extends through the shoulder support wall 10 and the fastening section of the base plate 4 and is suitable for accommodating a safety pin 60 (See FIG. 3 for an example).

Figure 4:
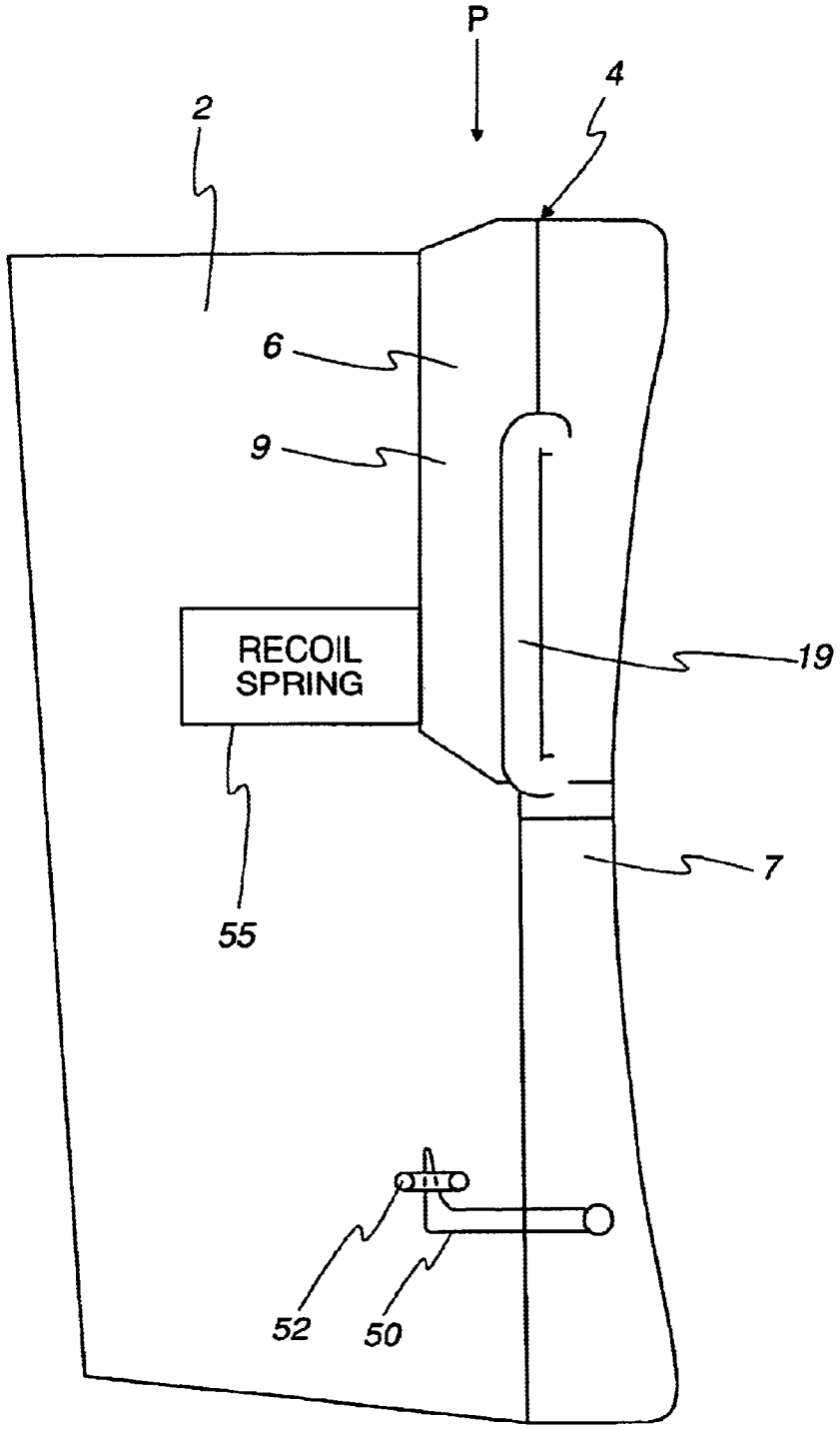
FIG. 4 is an illustration similar to FIG. 1, but showing an example recoil spring and an example snap hook.

Securing of the base plate 4 may also preferably occur via a snap hook 50 (see FIG. 4, for an example) that snaps from the base plate 4 into a corresponding counterpiece 52 (again, see FIG. 4 for an example) on the shoulder support 2 or, conversely, is mounted on the shoulder support 2 and snaps into the base plate 4.

One or more sling swivels 19 are preferably positioned on at least one side of the base plate 4. The fact that the sling swivels 19 are not applied to the shoulder support or weapon housing (as is common in the prior art), but instead are applied to the base plate 4, further reduces the hazard of destruction in the event of a fall because destroying forces cannot be introduced directly to the shoulder support 2 via the sling swivels 19, but only in a weakened form via the tongue-in-groove connection.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. In a firearm, a shoulder support element comprising:

a shoulder support adapted to support the firearm in a firing position, the shoulder support including a shoulder support wall;

a base plate for protection of the shoulder support, the base plate including a closure piece directly engaging the shoulder support, the closure piece including a fastening section that cooperates with a portion of the shoulder support wall to form a tongue-in-groove connection joining the base plate and the shoulder support, the base plate further including a covering cap mounted on the closure piece, wherein the closure piece is made from a first material comprising at least one of metal and reinforced plastic, and wherein the covering cap is made from a second material which is softer than the first material, wherein the shoulder support extends into the base plate and defines a first hole, the base plate defines a second hole which, when the base plate is mounted on the shoulder support, is aligned with the first hole, and the first and second holes are adapted to accommodate a safety pin to secure the base plate to the shoulder support.

2. A shoulder support element as defined in claim 1, wherein the first material comprises at least one of sheet-metal-reinforced plastic and fiber-reinforced plastic.

3. A shoulder support element as defined in claim 1 wherein the second material comprises at least one of an impact-resistant foamed plastic and an elastomer.

4. A shoulder support element as defined in claim 1 wherein the closure piece includes reinforcement ribs and the covering cap is fastened to the reinforcement ribs.

5. A shoulder support element as defined in claim 1 wherein the tongue-in-groove connection extends along an upper peripheral portion of the shoulder support.

6. A shoulder support element as defined in claim 1 wherein the fastening section lies on an outside surface of the shoulder support wall, the fastening section defines a groove facing the shoulder support wall and forming part of the tongue-in-groove connection, and a retaining connector forming part of the tongue-in-groove connection is located adjacent a rear edge of the shoulder support wall.

7. A shoulder support element as defined in claim 1 wherein the closure piece and the covering cap are fixedly connected.

8. A shoulder support element as defined in claim 1 wherein the closure piece and the covering cap are releasably connected.

9. A shoulder support element as defined in claim 1 wherein the covering cap of the base plate includes a concave rounding for facilitating support of the firearm in the firing position.

10. A shoulder support element as defined in claim 1 further comprising a safety closure for locking the covering cap to the shoulder support.

11. A shoulder support element as defined in claim 1, wherein a snap hook is provided on the base plate.

12. A shoulder support element as defined in claim 1 further comprising a sling swivel mounted on the base plate.

13. A shoulder support element as defined in claim 1, wherein the base plate is resiliently deformable.

14. In a firearm, a shoulder support element comprising:

a shoulder support adapted to support the firearm in a firing position, the shoulder support including a shoulder support wall;

a base plate for protection of the shoulder support, the base plate including a closure piece directly engaging the shoulder support and overlying at least a portion of the shoulder support wall, the closure piece including a fastening section that cooperates with the shoulder support wall to form a tongue-in-groove connection joining the base plate and the shoulder support, the base plate further including a covering cap mounted on the closure piece, wherein the closure piece is made from a first material comprising at least one of metal and reinforced plastic, and wherein the covering cap is made from a second material which is softer than the first material, wherein the closure piece includes reinforcement ribs projecting outwardly generally away from a front of the firearm and the covering cap is fastened to the reinforcement ribs.

15. In a firearm, a shoulder support element comprising:

a shoulder support adapted to support the firearm in a firing position, the shoulder support including a shoulder support wall;

a base plate for protection of the shoulder support, the base plate including a closure piece directly engaging the shoulder support and having a portion overlying at least a portion of the shoulder support wall, the closure piece including a fastening section that cooperates with the shoulder support wall to form a tongue-in-groove connection joining the base plate and the shoulder support, the base plate further including a covering cap mounted on the closure piece, wherein the closure piece is made from a first material comprising at least one of metal and reinforced plastic, and wherein the covering cap is made from a second material which is softer than the first material, wherein the shoulder support extends into the base plate and defines a first hole, the base plate defines a second hole which, when the base plate is mounted on the shoulder support, is aligned with the first hole, and the first and second holes are adapted to accommodate a safety pin to secure the base plate to the shoulder support.

16. A shoulder support element for a firearm, the shoulder support element comprising:

a shoulder support, the shoulder support adapted to support the firearm in a firing position, the shoulder support including a wall;

a base plate, the base plate including a fastening section and a covering cap, the covering cap overlying at least the fastening section of the base plate, the base plate directly engaging the shoulder support, the fastening section and a portion of the wall of the shoulder support cooperating to define a slidably releasable tongue-in-groove connection;

the fastening section made from a first material comprising at least one of metal and reinforced plastic; and the covering cap made from a second material, the second material softer than the first material.

17. The device of claim 16, wherein the shoulder support includes a protruding portion defining an aperture, and wherein a portion of the base plate includes a corresponding aperture, and including a retention pin sized for insertion into the apertures of the base plate and the shoulder support, and further wherein the tongue-in-groove connection is arranged so that the base plate is engaged or disengaged from the shoulder support exclusively by sliding the base plate relative to the shoulder support.

* * * * *